United States Patent [19]

Gage et al.

[11] Patent Number: 4,494,858

[45] Date of Patent: Jan. 22, 1985

[54] GEOMETRIC DESIGN REPRODUCING APPARATUS

[75] Inventors: Charles A. Gage, Webster; Timothy T. Blair, Shortsville; Thomas W. Morgan, Macedon, all of N.Y.

[73] Assignee: Xerox Corporation, Stamford, Conn.

[21] Appl. No.: 489,615

[22] Filed: Apr. 28, 1983

[51] Int. Cl.[3] ..... G03G 15/00

[52] U.S. Cl. ..... 355/3 TR; 355/3 SH; 355/14 TR; 355/16

[58] Field of Search ..... 355/3 SH, 14 SH, 3 TR, 355/14 TR, 16, 3 R, 14 R, 3 BE

[56] References Cited

U.S. PATENT DOCUMENTS

| | | | |
|---|---|---|---|
| 3,521,950 | 7/1970 | Gardner et al. | 355/3 |
| 3,591,276 | 7/1971 | Byrne | 355/3 SH X |
| 3,600,082 | 8/1971 | Knechtel | 355/8 |
| 3,836,245 | 9/1974 | Hastivell et al | 355/8 |
| 3,843,251 | 10/1974 | Washio et al. | 355/13 |
| 3,867,026 | 2/1975 | Ogawa | 355/8 |
| 4,014,605 | 3/1977 | Fletcher | 355/3 TR |
| 4,025,188 | 5/1977 | Radler Jr. et al | 355/16 |
| 4,068,937 | 1/1978 | Willense et al. | 355/16 X |
| 4,087,169 | 5/1978 | Fantuzzo | 355/3 TR |
| 4,179,211 | 12/1979 | Kimura et al. | 355/14 R |
| 4,257,700 | 3/1981 | Tsuda et al. | 355/3 TR |
| 4,268,157 | 5/1981 | Ebi et al. | 355/3 TR |
| 4,289,395 | 9/1981 | Stelben | 355/3 BE |
| 4,316,666 | 2/1982 | Ceelen | 355/3 TR |
| 4,327,991 | 5/1982 | Takeuchi et al. | 355/3 SH |

FOREIGN PATENT DOCUMENTS 2208143 6/1974 France

OTHER PUBLICATION

Zerox Disclosure Journal, Vol. 7, No. 2, Mar./Apr. 1982 pg 97; J.S. De Mar "Compact Zerographic Copier"

*Primary Examiner*—A. C. Prescott

[57] ABSTRACT

Electrostatographic reproducing apparatus comprising a movable imaging surface, transport means to transport the imaging surface along a path past the series of operational processing stations wherein a toner image and copy substrate contact station is provided, and wherein the distance along the imaging surface path from the image forming station where the lead edge of an image is formed on the imaging surface to the initial line of contact of the imaging surface with the copy substrate is equal to the distance along the copy substrate path from the copy sheet entrance to the initial line of contact of the lead edge of the copy substrate with lead edge of the image on the imaging surface. The apparatus further includes means at the beginning of each imaging cycle to simultaneously actuate the movable imaging surface with a copy substrate transport whereby the lead edge of the formed image on the imaging surface and the lead edge of the copy substrate simultaneously arrive at the initial line of contact.

12 Claims, 4 Drawing Figures

48
50
C
56
12
14
31
52
B
51
10
44
53
40
20
18
55
A
41
34
36
42
32
24
26
30
28
29
54

GEOMETRIC DESIGN REPRODUCING APPARATUS

CROSS REFERENCE TO RELATED APPLICATIONS

Reference is hereby made to copending application Ser. No. 489,622, Attorney Docket D/83007 entitled ELECTROSTATIC REPRODUCING MACHINE in the names of Charles A. Gage, Timothy T. Blair and Thomas W. Morgan filed concurrently herewith and to Ser. No. 489,621, Attorney Docket D/83021 entitled TONER TRANSFERRING METHODS AND APPARATUS in the names of Charles A. Gage, Timothy T. Blair and Thomas W. Morgan also filed concurrently herewith and to Ser. No. 489,620, Attorneys Docket D/83022 entitled REPRODUCING APPARATUS WITH SCROLLED IMAGING WEB in the names of Charles A. Gage, Timothy T. Blair and Thomas W. Morgan also filed concurrently herewith.

BACKGROUND OF THE INVENTION

This invention relates to electrostatographic reproducing apparatus and more particularly to a two cycle automatically operated compact copier structure. The electrostatic reproduction art has grown from the very early commercial models which included the early multi unit flat plate equipment available from Xerox Corporation which used separate charging, exposure, developing and fusing units to the Xerox 9200 family of products which is fully automated highly high speed complicated reproducing apparatus with sophisticated exposure document handling as well as copy sheet handling apparatus. Most of the commercial reproducing apparatus commonly in use today use a photoconductive insulating member which is typically charged to a uniform potential, thereafter exposed to a light image of an original to be reproduced. The exposure discharges the photoconductive insulating surface in exposed or background areas and creates an electrostatic latent image on the member which corresponds to image areas contained within the original document. Subsequent to the formation of the electrostatic latent image on the photoconductive insulating surface, it is made visible with a developing powder referred to in the art as toner. During development the toner particles are attracted to the image areas on the photoconductive insulating area to form a powder image thereon. This image is subsequently transferred to a support surface such as copy to which it may be permanently affixed by heating or the application of pressure. Following the transfer of the toner image to the support surface the photoconductive insulating layer is cleaned of residual toner to prepare it for the next imaging cycle.

While there has been ever increasing desire for an increased degree of sophistication and capability with regard to such automatic reproducing equipment there continues to remain a need in the low volume, slower, smaller apparatus part of the marketplace. This is particularly necessary to supply small businesses and individuals with a capability to reproduce original documents in a slower manner and at reduced costs. This particular segment of the reprographics market is particularly price sensitive. To satisfy this market, there is a continual need to reduce the selling and manufacturing costs. As a corollary, there is a continual desire by the manufactures within this area of the market to provide a smaller box with fewer parts in the total reproducing apparatus. In addition, there is continuing drive in this area of the market to provide portable, lightweight, compact, highly reliable, low cost machines.

Furthermore, even the simplest devices available on the market which automatically feed the documents and copy papers require complicated feed mechanisms including sophisticated clutches and logic assemblies, cam banks, timers, and other mechanical components, all of which require at least initial if not continual adjustment in order to operate satisfactorily. This dramatically increases the cost from the standpoint of both parts costs as well as assembly costs and initial set up and adjustment.

PRIOR ART

U.S. Pat. No. 4,289,395 (Stelben) illustrates a system wherein the distance from the paper feed roll to the point where copy paper contacts the belt is approximately equal to the distance from that point to the point where the image strikes the belt. This is accomplished with the use of activating clutches to insure that the copy paper arrives at the belts contact point simultaneously with the image on the belt.

SUMMARY OF THE INVENTION

In accordance with the present invention electrostatographic reproducing apparatus comprising a movable imaging surface which is movable along the path past a series of operational processing stations including at least an image forming station and developed toner image and copy substrate contact station is provided. The apparatus includes a copy substrate entrance plus means to feed the copy substrate along a copy substrate path with the distance along the imaging surface path from the image forming station where the lead edge of an image is formed on the imaging surface to the initial line of contact of the imaging surface with a copy substrate being equal to the distance along said copy substrate path from the copy sheet entrance to the initial line of contact with the lead edge of the copy substrate with the lead edge of the image on the imaging surface. The apparatus also includes means at the beginning of each imaging cycle to simultaneously actuate the movable imaging surface and the copy substrate transport whereby the lead edge of the formed image on the imaging surface and the lead edge of the copy substrate simultaneously arrive at the initial line of contact.

In a specific aspect of the present invention, the image formation station comprises in sequence a charging station to uniformly charge a photoconductive insulating layer and an exposure station to expose said photoconductive insulating layer to a light and shadow pattern.

In a further aspect of the present invention the imaging surface comprises a reusable, flexible web having an insulating surface supported between the web supply roll and a web take up roll. One end of said web being fastened to said web supply roll, the other end being fastened to said web take up roll and said web supply roll and take up roll being spaced apart with the image forming station and the developed toner image and copy substrate contact station positioned between the supply roll and the take up roll.

In a further aspect of the present invention, the apparatus includes a document viewing platen at the exposure station across which a document may be fed to expose the photoconductive insulating layer to the light and shadow pattern, the document being fed across the platen such that the lead edge of the document is exposed and forms the lead edge of the image on the photoconductive insulating layer.

In a additional aspect of the present invention, copy substrate feed means are provided at the copy substrate entrance to feed the copy substrate to the developed toner image and copy substrate contact station in wrapped around contact with the take up roll so that the leading edge of the copy substrate is in registration with the leading edge of the developed image on the imaging surface.

It is an object of the present invention to provide a novel apparatus for the automatic electrostatographic reproduction of original documents.

It is another object of the present invention to provide a very low cost, simple copy sheet feeding arrangement.

It is a further object of the present invention to provide an novel geometric design linking the distance a copy substrate travels in the machine to the distance from the formation of the image on the photoreceptor to the initial line of contact of the image on the photoreceptor with the copy substrate.

It is a further object of the present invention to provide a copy substrate feeding mechanism without the use of mechanical components or electrical actuating devices.

It is a further object of the present invention to provide a electrostatic copying apparatus which has a paper copy substrate handling system low in manufacturing cost and extremely simple to assemble and set up.

BRIEF DESCRIPTIONS OF THE DRAWINGS

Figure 2:
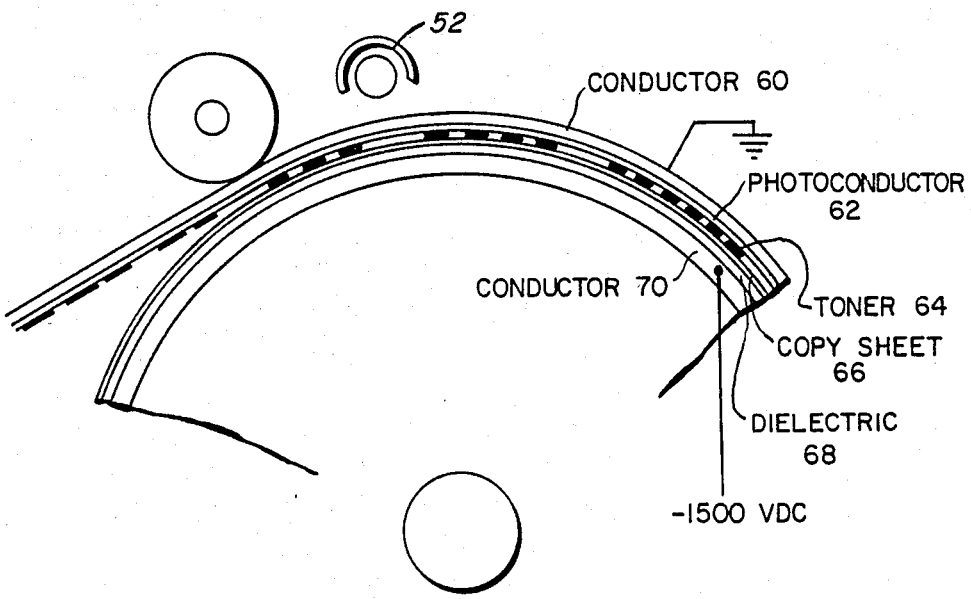
FIG. 2 is a schematic representation in cross-section of the sandwich formed during the transfer of the toner image from the insulating layer to the copy substrate with the apparatus and method according to the present invention.
Figure 3A:
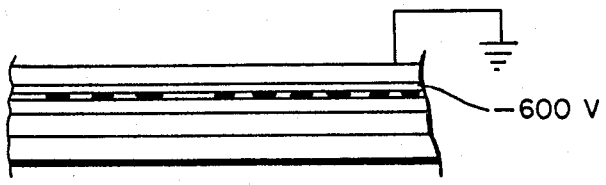
Figure 3B:
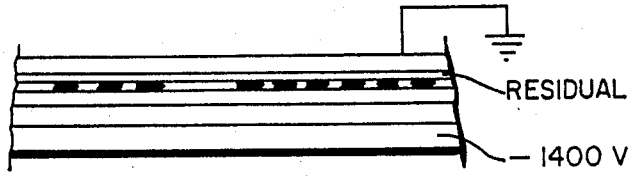

FIGS. 3*a* and 3*b* are greatly enlarged cross-sections of the transfer sandwich of FIG. 2. FIG. 3*a* represents a sandwich formed with the electrostatic latent image present on the photoconductive layer and FIG. 3*b* represents the sandwich after the translucent substrate of the photoconductive layer has been exposed to light and while the potential is applied to the conductive electrode.

DETAILED DESCRIPTION OF THE INVENTION

The invention will now be illustrated with reference to the schematic representation of FIG. 1, wherein a small copy reproducing machine is depicted. The overall concept is based on the use of a two cycle reusable retractable scroll photoreceptor system that is wound or wrapped up in "window shade" fashion during a first series of imaging steps and unwrapped during a second series of imaging steps. The machine concept comprises a flexible reusable strip 10 of photoconductive material on a conductive backing, one end of which is fastened by a strip of insulating leader 12 to take up roll 14, the other end of which is also attached by an insulating leader 18 to a photoconductive supply roll 20. Either the take up roll 14 or the supply roll 20 may be positively driven in both the forward and reverse directions while the other of which is spring biased like a window shade with, for example, a spring 31 to maintain tension on the strip photoconductor during the various process steps. Preferably the supply roll 20 is positively driven by means not shown and the larger take up roll is spring biased to maintain the tension in the strip of photoconductive material. Preferably, while the supply roll may be relatively small in diameter to provide compactness in size, the take up roll is of a size such that its circumference is at least as great as the image area on the photoconductor or the largest size document the apparatus is capable of reproducing. This enables transfer of the developed toner image according to the technique to be hereinafter described.

In making a copy an original document is manually inserted in slot 24 where it is transported past viewing platen 26 by a resilient foam roll 28 driven at constant speed in contact with the viewing platen. The document is viewed on the platen by virtue of lamp 30 in illumination cavity 32 through a lens 36 such as a Selfoc lens to expose the photoconductor 10 at exposure station 34. As the document is transported past the viewing platen, the photoconductor is transported past a charging station such as the illustrated cylindrical brush charging apparatus 41 and the exposure station 34 to form an electrostatic latent image on photoconductor 10. The electrostatic latent image is developed at development station 40 which may comprise a rotatable roll 42 with, for example, a single component developer. The developer roll may also alternatively be used to clean the photoconductor of any residual developer on its return path to the supply roll as will be described in more detail later. Following development the photoreceptor web with the discharged toner image is transported past self stripping roll 44 (described later) toward photoreceptor take up roll 14 with the lead edge of a sheet of copy paper being positioned to enter the nip of the take up roll 14 in registration with the lead edge of the image of the document on the photoconductive web. This may be accomplished, for example, by inserting a copy sheet in copy sheet entrance slot 48 which is driven by resilient foam drive roll 50 in contact with the take up roll 14. The copy sheet is maintained in contact with the take up drum through the action of idler rolls 56 and is wound in contact with the photoconductor around the take up roll to form a transform sandwich which will be described in greater detail hereinafter. The photoconductive web with the developed toner image side in contact with the copy sheet is wound up on the take up roll until the end of the image area of the photoconductive web has been contacted with the end of the copy sheet. An arcuate sandwich of photoconductive web, toner and copy sheet is thereby formed around a portion of the take up roll 14 it being noted that the circumference of the take up roll is greater than the length of the photoconductive imaging strip area 10 or the length of the copy sheet. Basically the take up roll comprises a conductive electrode and the leader of the photoconductor web is a dielectric material so that the sandwich formed on the take up roll comprises sequentially a grounded conductive photoconductor backing, charged and exposed photoconductor bearing an electrostatic latent image, the developed toner image, the copy paper, the dielectric and the conductive take up roll. After the sandwich is formed in the nip area, the translucent conductive backing of the photoconductor is exposed by lamp 52 placed just beyond the sandwich nip entrance with the light which passes through discharging the electrostatic latent image on the photoconductor.

After the sandwich has been formed a potential is applied to the conductive take up roll to form an electric field to drive the toner from the photoconductor to the copy sheet in image configuration. For example, if the photoconductor is negatively charged to a potential 600 to 700 volts, exposed to the document to be reproduced and developed with positively charge toner particles a negative bias on the conductive take up roll of 1400 to 1700 volts will create a strong field to drive the toner to the copy paper.

Once the entire image area of the photoconductive web has been taken up on the conductive take up roll in the transfer sandwich, the direction of the photoconductor web is reversed and the photoconductor is rewound on the supply roll. This may be readily accomplished by merely activating a microswitch at the end of the imaging path on the photoconductor which reverses the drive on the supply roll with the spring 31 in the take up roll insuring tension in the web regardless of take up roll diameter. A second microswitch is actuated on rewinding the supply roll which shuts the machine down. The bias on the conductive take up roll is maintained and the discharge lamps remain activated during the rewind cycle as the copy sheet is separated from the dielectric layer. When the rewinding sandwich (photoconductive layer and copy sheet) reach the self stripping roller 44, the photoconductive layer continues to rewind on the supply roll 18 as the copy sheet self strips around the self stripping roller 44 and carries on into the toner image fixing device illustrated here as a pressure roll fuser 53. Following fixing of the toner image on the copy sheet, the copy sheet is driven out of the copy exit chute 54. As the photoconductor is rewound, it passes by the developer roll which may be used to scavenge residual toner remaining on the photoconductor following development. Alternately, a cleaning blade 55 may be used to clean the residual toner from the photoconductor. Both of these cleaning techniques lend themselves to reclaiming toner and using it again. It should be noted that if a cleaning blade is used that it is preferred to positively drive the supply roll to insure that sufficient torque is available to pull the web past the cleaning blade.

With this configuration one need only insert the document in the document entrance chute 24, the copy sheet in the copy sheet entrance 48, press the "START PRINT" button to make a copy. The machine drives are activated, they drive the copy sheet between the driven foam drive roll and the photoconductor web take up roll while simultaneously the document is driven past the imaging platen, the photoconductor supply roll is driven forward as well as the charging brush being activated. When the photoconductor web has been taken up on the take up roll, the direction is reversed with the leading edge of the photoconductor being rewound up to the supply roll and the copy sheet exiting the machine. It should be noted that once the original document has been driven past the imaging platen on a scanning slit it is fed out the output document chute 29.

Figure 1:
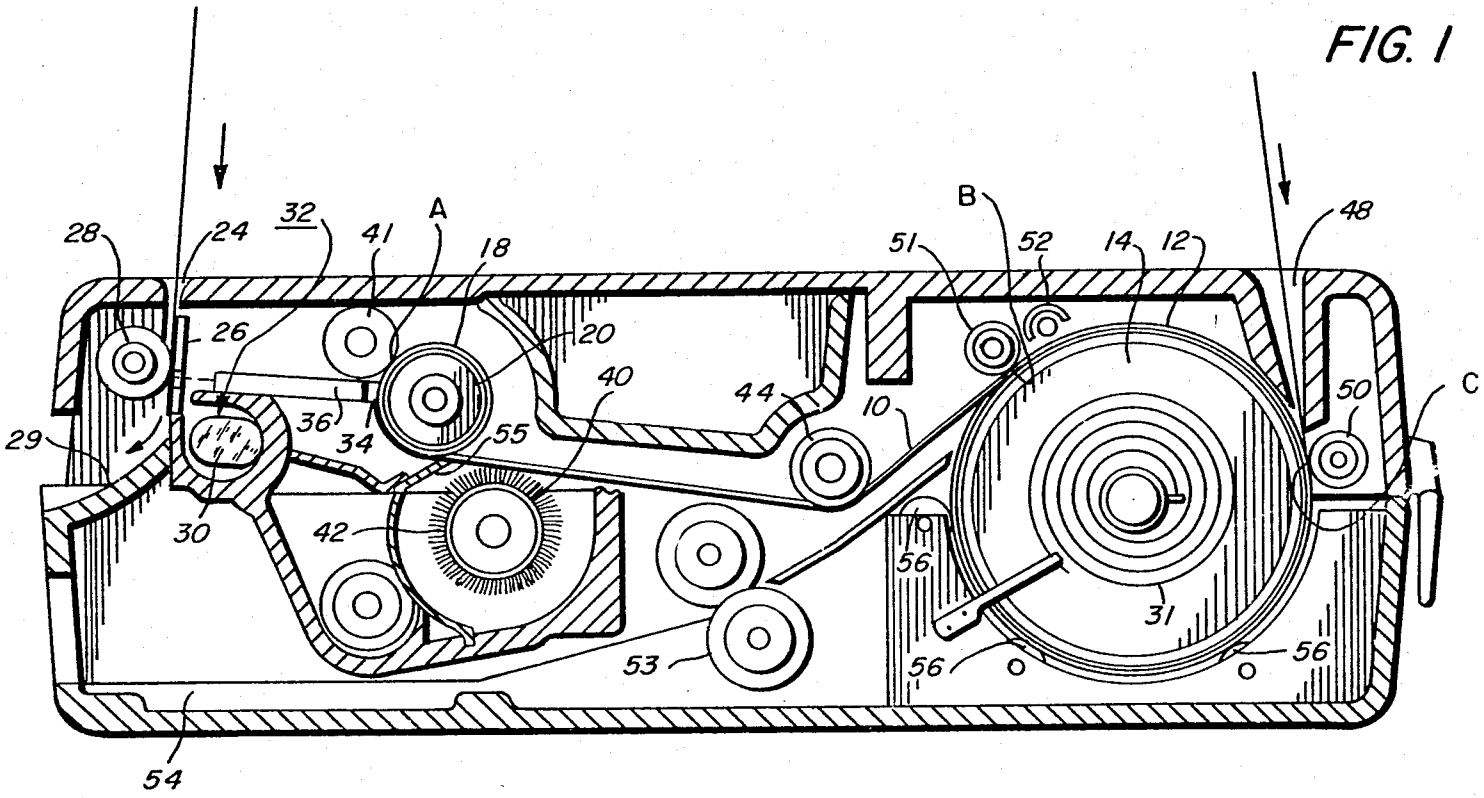
FIG. 1 is a schematic view in cross-section of an electrostatographic apparatus in which the present invention may be implemented.

As will be appreciated from FIG. 1, the illustrated design is based in part on a geometric relationship between the distance the copy paper travels and the distance the photoconductor travels. In particular, the distance from the copy paper entrance, the nip C between the feed roll 50 and the conductive take up roll 14 around the conductive roll to the contact point B where the roll 51 holds the photoconductive web in contact with the take up roll 14 and where the lead edge of the developed image on the photoconductor contacts the lead edge of the copy sheet is equal to the distance from the photoconductor charging station here illustrated as charging brush 41 and contact point A with the imaging layer 12 to the contact point of the lead edge of the developed image on the photoconductor with the lead edge of the copy sheet. As illustrated in FIG. 1, the distance AB along the photoconductive path is equal to the distance BC along the circumferential take up roll path. This geometric configuration provides a unique superior extremely uncomplicated design which in addition to its simplicity is extremely low in cost in that the conventional registration rolls, clutches, fingers, timing circuits, etc., are not required. With continued reference to FIG. 1, it will be observed that the insulating leader strips 12 and 18 are at least as long as the distance AB.

FIG. 2 schematically illustrates in exaggerated cross-section, the transfer sandwich which is formed according to the technique of the present invention. The photoconductive insulating layer 62 supported on a conductive backing 60 which will bear an electrostatic latent image may be charged negatively, for example, to about 600 volts followed by imagewise exposure and development by positively charged toner particles 64 in a development zone. As illustrated this imaging layer is wrapped around the transfer roller with the lead edge of the copy paper 66 being brought into contact with the lead edge of the image on the imaging layer. The transfer roller comprises a dielectric layer 68 on top of, for example, an aluminum coated cylindrical roll 70. The circumference of the cylindrical roll is sufficient to accommodate the entire length of the copy sheet and the image area of the photoconductor to insure the necessary electrostatic cooperation to be described hereinafter.

As mentioned previously, the sandwich is formed by wrapping the photoconductive insulating layer bearng the toner image in contact with a copy substrate and the dielectric layer around the conductive coated roll in the absence of any applied external electric field. Once the transfer sandwich has been formed a transfer field may be applied between the ground plane (the conductive backing) of the photoconductor and the conductive roll in such a way as to drive the toner from the photoconductive insulating layer onto the copy paper. During this transfer operation pressure is maintained low in order to insure the absence of hollow character generation and image disturbance by excessive pressure. However, during the formation of the transfer sandwich it should be understood that sufficient pressure is applied to remove air from the gap as the copy paper and photoreceptor are wound around the transfer roll. This pressure is sufficient to provide good contact to delete the air so that upon the application of an electric field across the various members, no air breakdown or field reduction due to spacing will occur. During the wrapping operation the conductive back of the photoconductive layer which may be transparent but is at least translucent is exposed to light by lamp 52 after the incoming nip where the sandwich is formed to discharge the electrostatic latent image on the photoconductor.

Once the transfer sandwich has been formed a negative potential of, for example, 1400 to 1700 volts DC may be applied to the aluminum coating on the roll to thereby create the necessary electric field between the ground plane of the photoconductor and the coated roll to thereby create the strong field which drives the toner from the photoconductor surface to the copy paper. Following application of this field and while the field is still being applied, the sandwich may be separated to provide a copy substrate having the toner on it in image configuration. As the sandwich is separated by being unwrapped, for example, the dielectric layer may be first separated from the copy substrate and the electric field goes to zero since the plates of the capacitor formed by the transfer sandwich are physically separated. Since the toner has already been attracted to the copy paper, the copy paper can be readily separated from the photoconductive layer. As a result of the exposure of the conductive backing on the photoconductor the image potential holding the toner material on the photoconductor is very low. It should be explained that following formation of the transfer sandwich the image charge on the insulating layer is removed in any suitable way. As illustrated, typically the photoconductor material is backed by a translucent conductive substrate so that upon illumination with radiation the charge in image configuration is dissipated by the photoconductive material being rendered conductive upon exposure to the radiation. In this regard it is necessary only in this configuration that the back of the photoconductive layer be sufficiently translucent to let enough light in to discharge the photoconductor layer.

While the invention has up to this point been described with particular reference to a photoconductive insulating material as the imaging layer it should be noted that the imaging layer may comprise any insulating layer upon which an electrostatic latent image may be formed. If such a layer is insulating and not photoconductive means other than the lamp 52 must be used to discharge the electrostatic latent image after the sandwich is formed and before it is separated.

Any suitable photoconductive layer may be used in the practice of the present invention. Particularly preferred type of composite material used in xerography is illustrated in the U.S. Pat. No. 4,265,990 the disclosure of which is hereby totally incorporated in its entirety. The photoconductive layer described in the above noted patent illustrates a photosensitive member having at least two electrically operative layers, one layer comprises a photoconductive layer which is capable of photogenerating holes and injecting photogenerated holes into a contiguous charge transport layer. Typically this comprises a polycarbonate resin containing from about 25 - 75% by weight of one or more of certain substituted diphenyldiamine compounds. Various generating layers comprising photoconductive layers exhibiting the capability of photogeneration of holes and injection of the holes into the charge transport layer have also been investigated. Typical photoconductive materials utilized in the generating layer included amorphous selenium, trigonal selenium, and selenium alloys such as selenium tellurium, tellurium arsenic, selenium arsenic and mixtures thereof. This photoconductive layer is typically coated on a conductive substrate which may, for example, be a very thin layer of aluminum oxide which is electrically connected to ground. As previously noted the conductive substrate is translucent or transparent to light to enable discharge of the charged pattern in the photoconductive layer at the appropriate time during the transfer operation.

As previously illustrated, the photoconductor insulating layer can be charged and exposed and the image developed with charged toner particles in conventional manner. During the developement of the electrostatic latent image on the photoconductor it should be noted that charged toner particles which are charged to a polarity opposite the polarity of charge on the photoconductive insulating layer partially neutralize the charge in image configuration to bring it down to a level of the order of around −100 to −200 volts. Following formation of the developed image the photoconductive layer is brought into contact with the copy paper in the absence of an electric field and as illustrated, wrapped around a dielectric coated conductive roll. It should be noted that while the transfer sandwich as illustrated is a cylindrical roll it must be appreciated that other types of transfer sandwiches may be formed. For example, the sandwich may be formed in a planar configuration merely by passing the developed photoconductor layer and copy paper between the same type of sandwich supporting members.

The dielectric layer in the transfer sandwich which may be the leader for the photoconductive layer forms a blocking electrode thereby preventing air breakdown by way of prohibiting the current from flowing through the photoreceptor to the conductive roll and thereby prevents field collapse. It maintains the field as high as possible insuring good transfer. Any suitable dielectric layer may be used for this purpose. A typical material is Mylar which is a polyethylene terephthalate available from E. I. DuPont and Company. During the formation of the sandwich, the copy paper is inserted between the photoreceptor and the dielectric layer. In addition, in order to maximize the electric field during the transfer operation the thinner the paper the greater is the transfer efficiency in the transfer operation. It should be noted in this connection that the transfer efficiency goes up with the strength of the field and reaches a plateau. Thus in regulating the transfer sandwich when the bias is applied it is best to apply the bias so that it will be capable of handling papers of all thickness.

After the transfer sandwich has been formed, the image charge on the photoconductive layer may be discharged in any suitable manner. Typically with the configuration illustrated in the present embodiment this is done by exposure of the back of the photoconductor to light. This enables the potential on the photoreceptor to be discharged thereby permitting the toner to be more readily attracted to the copy paper in response to the field when the field is applied to the conductive electrode.

A field can be applied to the conductive electrode either before, concurrently or after discharge. The important factor being that you do not separate the sandwich, i.e., do not unwind the transfer member without first having discharged the photoreceptor. Following discharge of the charged image on the photoconductive insulating layer a potential may be applied to the conductive aluminum coated roll to create a field to drive the toner from the photoreceptor to the copy paper. Typically this is of the order of negative 1400 to 1700 volts, thereby creating a strong field which drives the toner from the photoconductor to the copy paper.

During the formation of the transfer sandwich and in particular the wrapping of the paper, photoreceptor and the dielectric layer together it is important to not provide any wrong sign or in the present case plus charging function to the copy paper or the dielectric layer since such will thereby tend to reduce the transfer field. This may be insured by providing a conductive brush on the back of the sandwich roll to leak away any wrong sign charge that may be generated between the copy paper and the Mylar.

With the illustrated transfer method and apparatus we have found that the transfer efficiency, which is the fraction of the developed mass of toner which is transferred to paper compared to the total mass of toner on the photoconductive layer, to be typically of the order of 85%–90% which compares very, very favorably and indeed exceeds many of the prior art techniques which could only achieve a maximum transfer efficiency of around 80%–85% under ideal conditions.

As may be appreciated from reference to the foregoing description the present invention provides a novel geometric copier design which links the distance the copy substrate travels in the machine to the distance from the formation of the image to the transfer area. It is a simplified design providing a substrate feeding capability without the use of complex mechanical components or electrical actuating devices. It has the beauty of being enormously low in manufacturing costs and extremely simple to assemble and adjust together with the individual parts necessary to perform those functions.

Furthermore, as a result of the geometry complicated copy sheet and document feed mechanisms including sophisticated clutches and other mechanical improvements which may malfunction or require maintenance are eliminated.

While the invention has been described with reference to specific embodiments, it will be apparent to those skilled in the art that many alternatives, modifications and variations may be made. For example, while the invention has been illustrated with particular reference to the use of a take up roll on which the imaging layer and copy sheet are wrapped and unwrapped, it should be noted that other geometries work equally well as long as the relationship between the distance from the image forming station to contact point is equal the distance from the copy sheet entered to the initial line of contact. It is intended that all such embodiments as well as other alternatives, modifications and variations are embraced within the spirit and scope of the appended claims.

What is claimed is:

1. Electrostatographic reproducing apparatus comprising a movable imaging surface, means to transport said imaging surface along a path past a series of operational processing stations including at least an image forming station and a developed toner image and copy substrate contact station, said apparatus also including a copy substrate entrance to the apparatus, a copy substrate path to guide said copy substrate from said entrance to said copy substrate contact station, means to transport said copy substrate along said copy substrate path, the distance along the imaging surface path from said image forming station where the lead edge of an image is formed on the imaging surface to the initial line of contact of the imaging surface with the copy substrate being equal to the distance along said copy substrate path from the copy sheet entrance to the initial line of contact of the lead edge of the copy substrate with the lead edge of the image on the imagining surface, and means at the beginning of each image cycle to simultaneously actuate said movable imaging surface and said copy substrate transport whereby the lead edge of the formed image on the imaging surface and the lead edge of the copy substrate simultaneously arrive at the initial line of contact.

2. The apparatus of claim 1, further including means to transfer said toner image from said imaging surface to said copy substrate while they are in contact.

3. The apparatus of claim 1, wherein said imaging surface comprises a photoconductive insulating layer on a conductive substrate.

4. The apparatus of claim 3, wherein said image forming station comprises in sequence a charging station to uniformly charge said photoconductive insulating layer and an exposure station to expose said photoconductive insulating layer to a light and shadow pattern to be reproduced.

5. The apparatus of claim 1, wherein said imaging surface comprises an insulating layer which is charged in image configuration.

6. The apparatus of claim 1, wherein said imaging surface is a reusable, flexible web having an insulating surface supported between a web supply roll and a web take up roll, one end of said web being fastened to said web supply roll, the other end of said web being fastened to said web take up roll, said web supply roll and said web take up roll being spaced apart and wherein said image forming station and said developed toner image and copy substrate contact station are positioned between said supply roll and said take up roll.

7. The apparatus of claim 4, further including a document viewing platen at the exposure station across which a document may be fed to expose said photoconductive insulating layer to the light and shadow pattern of said document, and means to feed the document across said platen such that the lead edge of the document is exposed to and forms the lead edge of the photoconductive insulating layer.

8. The apparatus of claim 6, further including copy substrate feed means to feed said copy substrate from said copy substrate entrance to said developed toner image and copy substrate contact station in wrapped around contact with said web take up roll to the contact station so that the leading edge of said copy substrate is in registration with the leading edge of the developed image on said imaging surface.

9. The apparatus of claim 8, wherein the circumference of said web take up roll is at least equal to the length of said copy substrate.

10. The apparatus of claim 9, wherein said copy substrate is maintained in contact with the take up roll while being wrapped around said take up roll by a plurality of idler rolls in driving engagement with the take up roll.

11. The apparatus of claim 10, wherein said copy substrate is wrapped around said take up roll at the same speed and in contact with the toner bearing side of said imaging surface web.

12. The apparatus of claim 11, including means to transfer said toner image from said imaging surface to said copy substrate.

* * * * *